United States Patent [19]

Lebrecht

[11] Patent Number: 5,033,279

[45] Date of Patent: Jul. 23, 1991

[54] PADLOCK COVER WITH SHACKLE SEAL

[75] Inventor: Horst Lebrecht, Reedsburg, Wis.

[73] Assignee: Master Lock Company, Milwaukee, Wis.

[21] Appl. No.: 518,895

[22] Filed: May 4, 1990

Related U.S. Application Data

[63] Continuation-in-part of Ser. No. 408,331, Sep. 18, 1989, abandoned, which is a continuation of Ser. No. 288,046, Dec. 31, 1988, abandoned, which is a continuation of Ser. No. 162,831, Mar. 2, 1988, abandoned, which is a continuation of Ser. No. 038,116, Apr. 14, 1987, abandoned, which is a continuation of Ser. No. 888,307, Jul. 22, 1986, abandoned, which is a continuation of Ser. No. 699,171, Feb. 7, 1985, abandoned.

[51] Int. Cl.[5] ..... E05B 67/38

[52] U.S. Cl. ..... 70/55

[58] Field of Search ..... 70/54, 55, 56; 223/113; 36/4, 7.3

[56] References Cited

U.S. PATENT DOCUMENTS

| | | | |
|---|---|---|---|
| 297,469 | 4/1884 | Stickney | 36/7.3 |
| 954,061 | 4/1910 | Van Taxis | 223/113 |
| 2,375,488 | 5/1945 | Olson | 70/54 |
| 4,224,813 | 9/1980 | Hampton | 70/55 |
| 4,226,100 | 10/1980 | Hampton | 70/55 |
| 4,317,344 | 5/1982 | Barnard | 70/55 |

*Primary Examiner*—Robert L. Wolfe

*Attorney, Agent, or Firm*—Pennie & Edmonds

[57] ABSTRACT

A flexible elastic padlock cover both form-fit and stretch-fit to the padlock body and having handle means for ready handling of the cover in putting it on and taking it off. The cover may be split so that the upper half can remain on the body while the lower half is removed for lock operation.

5 Claims, 3 Drawing Sheets

PADLOCK COVER WITH SHACKLE SEAL

This application is a continuation-in-part of U.S. Ser. No. 07/408,331 filed Sept. 18, 1989, abandoned which is a continuation of U.S. Ser. No. 07/288,046 filed Dec. 31, 1988, abandoned which is a continuation of U.S. Ser. No. 07/162,831 filed March 2, 1988, abandoned which is a continuation of U.S. Ser. No. 07/038,116 filed April 14, 1987, abandoned which is a continuation of U.S. Ser. No. 06/888,307 filed July 22, 1986, abandoned which is a continuation of U.S. Ser. No. 06/699,171 filed Feb. 7, 1985, abandoned.

BACKGROUND OF THE INVENTION

Numerous protective covers have been proposed for use on shackle padlocks (see U.S. Pat. Nos. 3,848,440; 4,244,813; and 4,317,344). These covers are positioned on the locks for the purpose of preventing (or reducing) the entry of contaminants into the lock through the keyhole opening.

Other sealing proposals have been made known to the industry for the purpose of sealing the openings in the lock body through which the shackles reciprocate during operation (see U.S. Pat. Nos. 2,375,458 and 2,904,985).

RELATIONSHIP WITH OTHER APPLICATION

This application is a continuation-in-part of pending U.S. application Ser. No. 07/408,331 filed Sept. 18, 1989 which is a continuation of U.S. application Ser. No. 07/288,046 filed Dec. 31, 1988 which is a continuation of U.S. application Ser. No. 162,831 filed Mar. 2, 1988 which is a continuation of U.S. application Ser. No. 038,116 filed Apr. 14, 1987 which is a continuation of U.S. application Ser. No. 888,307 filed July 22, 1986 which is a continuation of U.S. application Ser. No. 699,171 filed Feb. 7, 1985 entitled "Padlock Cover With Shackle Seal".

SUMMARY OF THE INVENTION

Broadly, the present invention comprises a flexible lock body cover slightly smaller than the lock body with a bottom portion and side walls upstanding from the bottom which cover is placed on the lock body to protect the keyhole opening. The cover side walls are stretched as the cover is placed on the body so that after placement of the cover on the lock body the walls pull against the lock body in elastic tension to form a seal therewith. The cover has a handle mounted on it to permit the cover to be readily pulled to stretch it or otherwise deform it during its placement on and removal from the lock body.

It is a feature of the invention that in addition to the keyhole cover, shackle seals may be used to seal the openings between the shackle and the lock body.

It is a further feature that the lock body cover may include a body-holding ban to facilitate use of the cover.

DESCRIPTION OF THE PREFERRED EMBODIMENT

Figure 1:
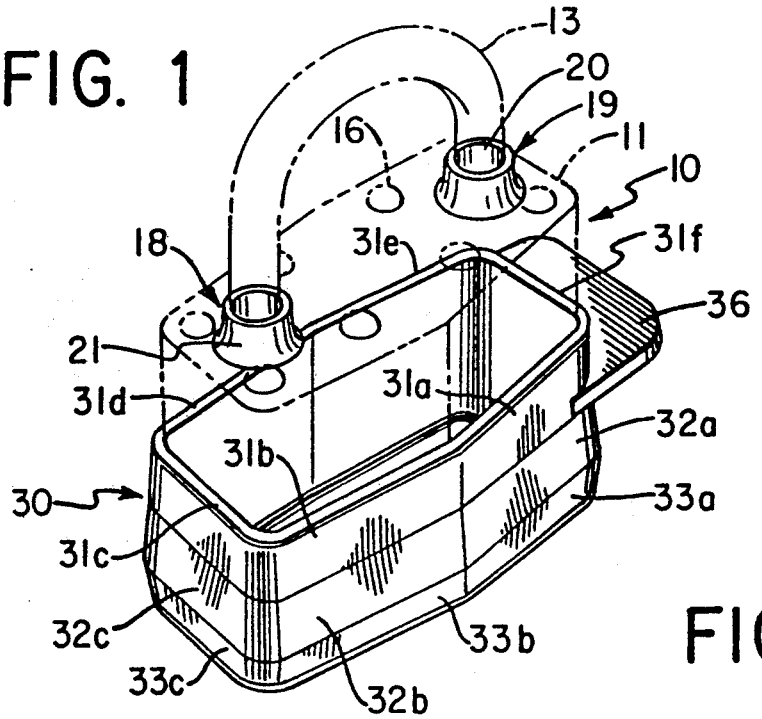
FIG. 1 is a perspective view of the lock dust cover and shackle seals with the lock shown in dashed lines.
Figure 3:
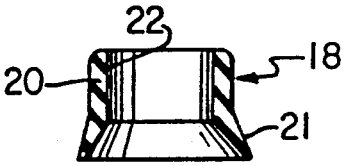
FIG. 3 is an elevational sectional view through a shackle seal.

Referring to the drawings, laminated padlock 10 includes lock body 11, laminates 12 and **12*b* (see FIG. 4), U-shaped shackle 13 with longer shackle legs 14 and shorter shackle leg 15. Lock 10 also includes upper and lower rivets 16 which hold the laminates 12 together. Also shown in lock body is skirt portion 17. A keyhole (not shown) is positioned in the bottom of the lock body 11. In its unlocked position, shorter shackle leg 15 is withdrawn from the lock. In this unlocked position, rubber seals 18, 19 and their tubular wall portions 20 and flared lower portions 21 are placed onto, around, and worked along shackle 13. Each seal 18, 19 has a circular opening 21 for receiving shackle 13. Circular openings 22 have diameters slightly smaller than the diameter of the shackle 13**, to provide a fit tight enough to afford an effective seal against dust, moisture and other materials deleterious to the mechanism within the lock.

Figure 4:
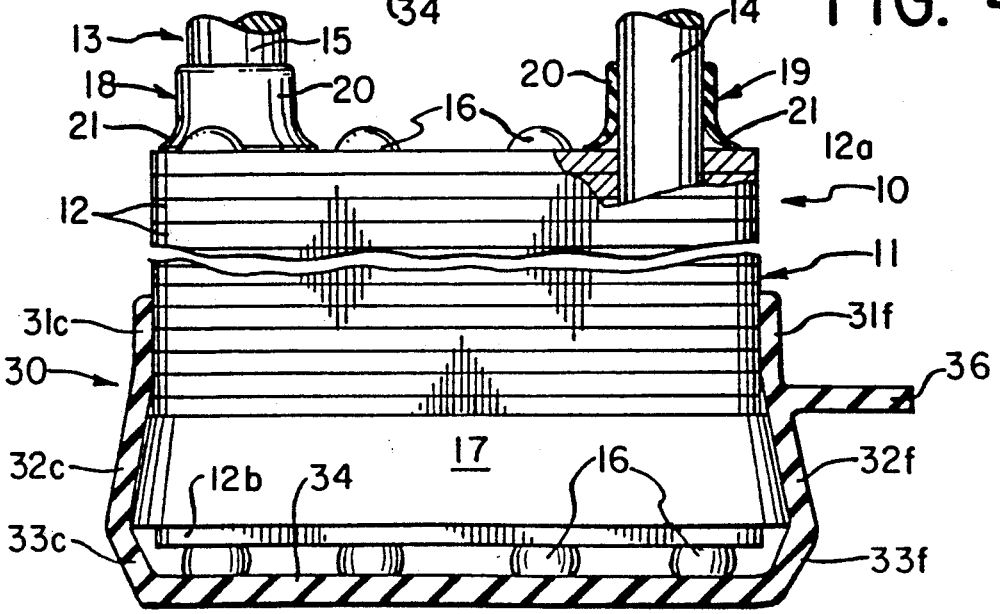
FIG. 4 is an elevational partial sectional view of the dust on the lock and shackle seals on the shackles with one seal shown in section.

When lock 10 is closed by causing the shorter leg 15 to enter the body and the longer shackle leg 14 to move further into the lock body 11, seals 18, 19 resting on the top body laminate **12*a* will deform by flaring outwardly to provide a better seal (see FIG. 4). Alternatively, after the shackle 13 is in the locked position, the seals can be urged downwardly toward and against the top laminate 12*a* to deform the flared portion as shown in FIG. 4**.

Figure 2:
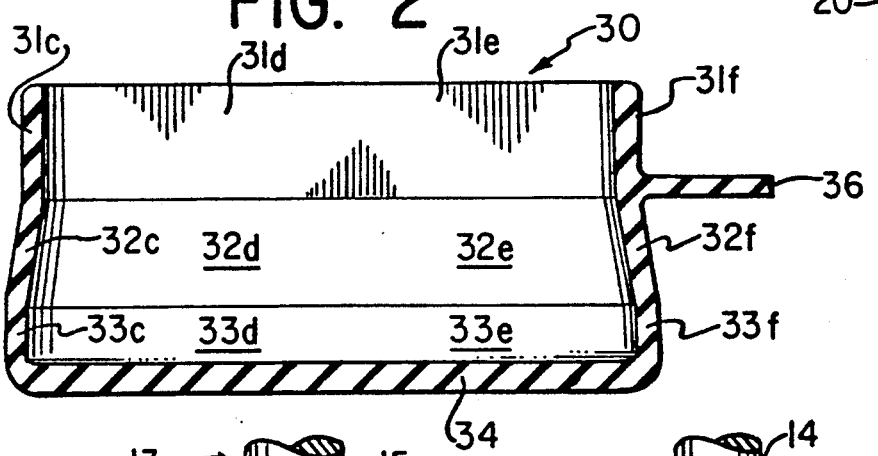
FIG. 2 is an elevational sectional view through the dust cover.

Dust keyhole rubber cover 30, like lock body 11, is generally hexagonal with vertical wall sections **31*a*, 31*b*, 31*c*, 31*d*, 31*e*, and 31*f*, sloping wall sections 32*a*, 32*b*, 32*c*, 32*d*, 32*e*, and 32*f*, lower wall sections 33*a*, 33*b*, 33*c*, 33*d*, 33*e*, and 33*f*, and bottom panel 34. (Sections 32*d*, 32*e* and 33*d* and 33*e* are not shown). Wall sections 33*c* and 33*f* are generally vertical when the cover 30 is in its relaxed position (see FIG. 2) and such sections slope when cover 30 is in its installed position (see FIG. 4**).

Rubber handle 36 is positioned to project from the intersection of vertical wall section **31*f* and sloping wall section 32*f*. Handle 36 is large enough to be held and pulled by the thumb and forefinger to assist in putting cover 30** on the lock and in removing it.

Cover 30 is sized and proportioned so that the cover walls are in a stretched extended condition after they have been put on the lock as shown in FIG. 4 thereby providing a seal between wall sections 31, 32 and 33 and the lock body 11. The upper sloping wall sections 32 and lower wall sections 33 readily accommodate the skirt portion 17 of the lock body 11 without requiring the cover 30 to be overly stretched as it is put on and taken off the lock body. Cover bottom 34 is positioned substantially parallel to and spaced from the bottom laminate 12*b* which includes a keyhole (not shown). While rubber is preferred as the material for the seals and cover, it is contemplated that other flexible, stretchable or deformable materials may be used.

Figure 5:
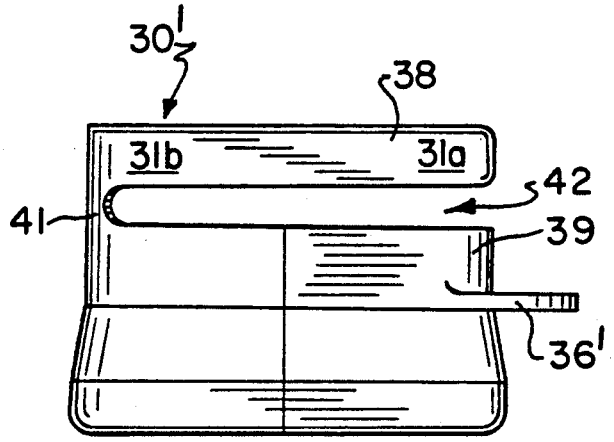
FIG. 5 is an alternative hinged lock cover in which a portion of the cover is removable.
Figure 6:
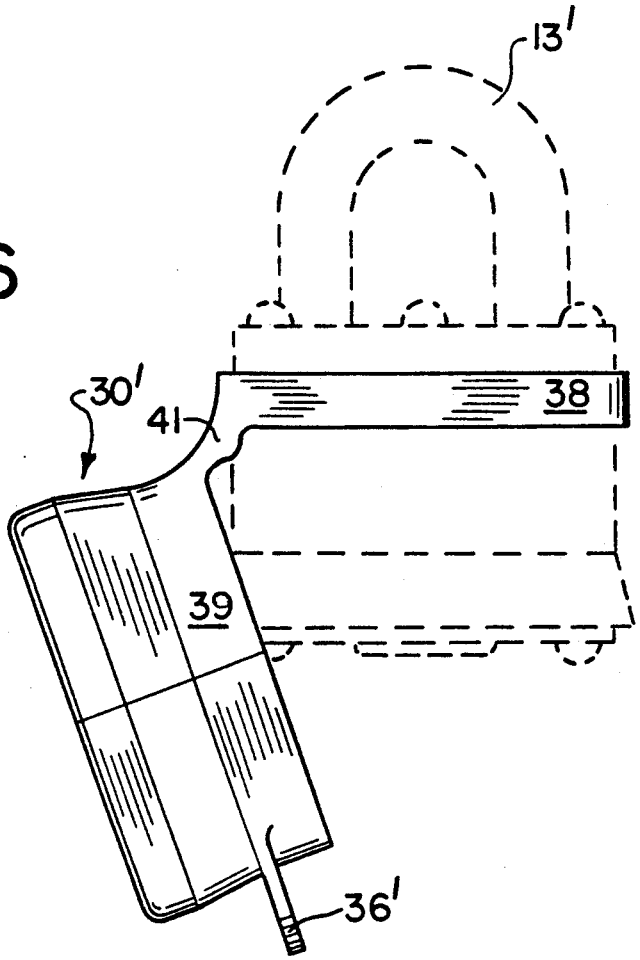
FIG. 6 shows the alternative cover partially removed to permit key operation to unlock or lock the padlock.

Turning to FIGS. 5 and 6, an alternative embodiment is shown in which keyhole cover 30' consists of body-holding ban 38 and a removable lower cover portion 39. Ban 38 and cover portion 39 are attached through cover hinge 41. Preferably, cover 30' is made by molding ban 38 and portion 39 as an integral part including handle 36'. Slot opening 42 in walls 31*a'* and *b'* and 31*e'* and *d'* (not shown in FIG. 5; see FIG. 1) creates cover hinge 41. Ban 38 and portion 39 may be separate elements suitably connected by a separate hinge or a hinge integral with ban 38 and portion 39. Also shown is shackle 13.

Figure 7:
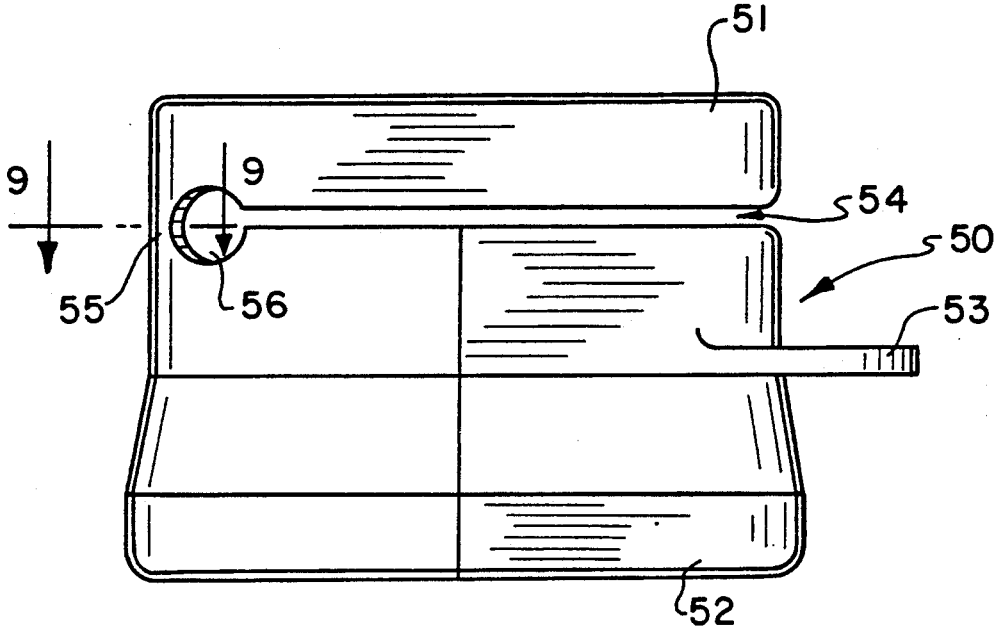
FIG. 7 is a further embodiment of the hinged lock cover having a configured hinge defined in part by circular openings in the cover walls.
Figure 8:
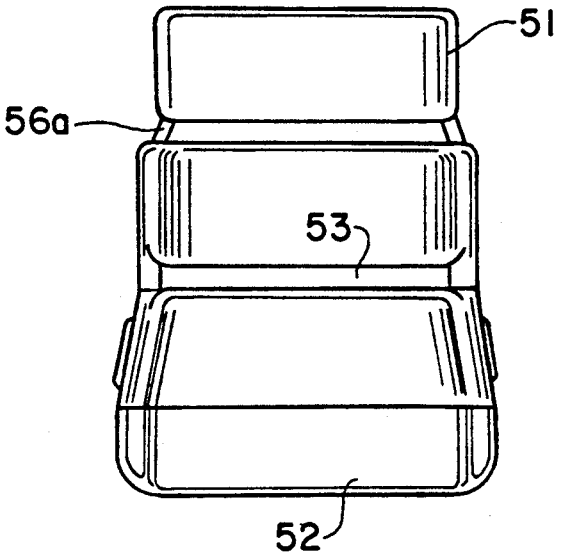
FIG. 8 is a side elevational view of the FIG. 7 cover taken from the handle side of the cover.
Figure 9:
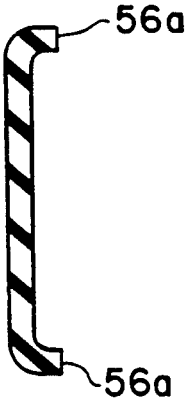
FIG. 9 is a sectional view taken along line 9—9 of FIG. 7.

Finally, turning to FIGS. 7, 8 and 9, a further alternative hinged cover 50 is shown having band 51, keyhole cover portion 52, handle 53, slot opening 54 and hinge 55. Also shown is an enlarged circular opening 56 at the hinge end of slot opening 54 to make hinge 55 more easily deformed when the keyhole portion 52 is moved down and off the lock body. Circular openings 56 have diameters larger than the width of slot 54 and openings 56 include inner walls 56*a* (see FIGS. 7 and 9).

I claim:

1. A key-operated shackle padlock protective cover for covering the padlock including its keyhole, having a lock body with multiple sides including a top plate, a bottom and vertical sides, to protect from dust, moisture and other contaminated materials comprising a flexible stretchable one-piece lock body cover portion sized and shaped to cover the keyhole and engage only the lock body sides and bottom in elastic sealed engagement; and a handle portion mounted on the flexible cover portion for pulling the cover to stretch it during placement and removal of the cover on the lock body.

2. The one-piece cover of claim 1 having a bottom element generally parallel to the lock bottom plate and the cover having side wall sections which generally follow the contours of the lock body and on one of such side wall sections an integral handle portion is mounted.

3. The cover of claim 2 in which the cover comprises a lock body-holding ban and a lower lock body portion and hinge means forming part of a side wall section and connecting the ban and the lower portion whereby the lower portion is removable from the lock body while the ban remains engaged with the lock body through the hinge means.

4. The protective cover arrangement of claim 1 having in addition a flexible shackle seal mounted on the shackle for sealed engagement with the top lock plate.

5. The protective cover of claim 4 in which the shackle seal includes a flared portion in engagement with the top plate.

* * * * *